US006595495B1

(12) United States Patent
Hung

(10) Patent No.: US 6,595,495 B1
(45) Date of Patent: Jul. 22, 2003

(54) WIRE WINDING AND ORDERING DEVICE FOR ELECTROMOTIVE WINCH

(75) Inventor: Victor Hung, Lu Chu Hsiang (TW)

(73) Assignee: Shinn Fu Corporation (TW)

( * ) Notice: Subject to any disclaimer, the term of this patent is extended or adjusted under 35 U.S.C. 154(b) by 0 days.

(21) Appl. No.: 10/067,248

(22) Filed: Feb. 7, 2002

(51) Int. Cl.[7] ..... B66D 1/00; B66D 1/36

(52) U.S. Cl. ..... 254/326; 254/362; 254/323; 242/397.2

(58) Field of Search ..... 254/323, 326, 254/362, 375, 389; 242/397.2, 397.4, 390.9, 484.2, 484.3

(56) References Cited

U.S. PATENT DOCUMENTS 2,660,382 A * 11/1953 Wilson ..... 242/478.2
3,309,066 A * 3/1967 Carlson ..... 254/268
5,573,091 A * 11/1996 Hung ..... 192/12 R
5,927,693 A * 7/1999 Hackl ..... 254/398

* cited by examiner

*Primary Examiner*—Kathy Matecki
*Assistant Examiner*—Evan Langdon
(74) *Attorney, Agent, or Firm*—Bacon & Thomas, PLLC

(57) ABSTRACT

A wire winding and ordering device for an electromotive winch is installed at a front opening of a winch. The wire winding and ordering device includes a transversal displacement element and a longitudinal displacement element. The longitudinal displacement element is movably combined with a transversal displacement element and is penetrated through by a twisting wire so as to clamp the wire. Thereby, the twisting wire with or without burden can be rewound in order.

7 Claims, 6 Drawing Sheets

WIRE WINDING AND ORDERING DEVICE FOR ELECTROMOTIVE WINCH

BACKGROUND OF THE INVENTION (a) Field of the Invention

The present invention relates to a wire winding and ordering device for an electromotive winch, wherein a transversal displacement element and a longitudinal displacement element are installed at a front opening of a winch, thereby, the twisting wire can be rewound orderly.

(b) Description of the Prior Art

Referring to FIG. 1, a motor-driving gear set is used to drive a scrolling shaft to rotate so that the twisting wire can rewind and release freely. However, in this prior art, the twisting wire is rewound by an outer force. Otherwise, it can not be in order due to the looseness of the twisting wire. A prior art wire winding and ordering device for an electromotive winch is disclosed in U.S. Pat. No. 3,051,447 and Taiwan Pat. No. 100187 disclosed by the applicant of the invention.

In the prior art, the twisting wire can be rewound in order, while as no burden, since no gravitational force is applied to the twisting wire, thus the twisting wire is in a free condition. Since the twisting wire is rigid, and the outer diameter of the scrolling shaft is smaller, and thus the wire is easy disorder. Moreover, when the prior art wire winding and ordering device for an electromotive winch is pulled by hands. A twisting wire on the scrolling shaft will has a loose section due to the inertial force of the twisting wire being pulled by the scrolling shaft. Thereby, the twisting wire will entwine.

SUMMARY OF THE INVENTION

Accordingly, the primary object of the present invention is to provide a wire winding and ordering device for an electromotive winch which is installed at a front opening of a winch. The wire winding and ordering device includes a transversal displacement element and a longitudinal displacement element. The longitudinal displacement element is movably combined with a transversal displacement element and is penetrated through by a twisting wire so as to clamp the wire. Thereby, the twisting wire with or without burden can be rewound in order.

Another object of the present invention is to provide a wire winding and ordering device for an electromotive winch, an elastic resisting element is embedded in the screw hole in the longitudinal displacement element so as to have preferred clamping effect.

A further object of the present invention is to provide a wire winding and ordering device for an electromotive winch, wherein a resisting gear is stalled at a predetermined end of the scrolling shaft of the winch for reducing the inertial force from the rotating of the scrolling shaft. Thereby, the scrolling shaft will not disorder as it is loose.

The various objects and advantages of the present invention will be more readily understood from the following detailed description when read in conjunction with the appended drawing.

DETAILED DESCRIPTION OF THE PREFERRED EMBODIMENTS

Figure 1:
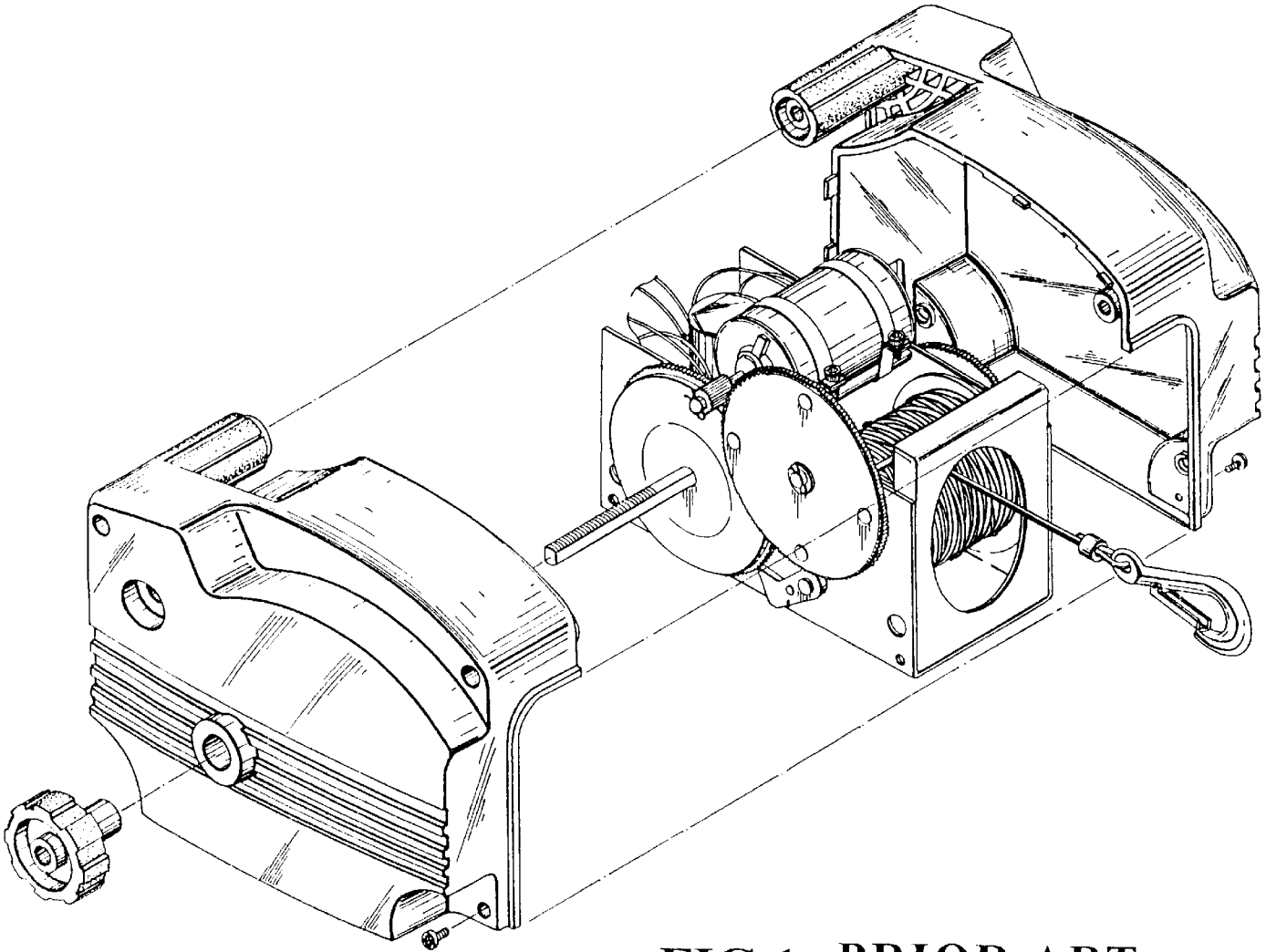
FIG 1 PRIOR ART
FIG. 1 is an exploded perspective view of a prior art winch.
Figure 2:
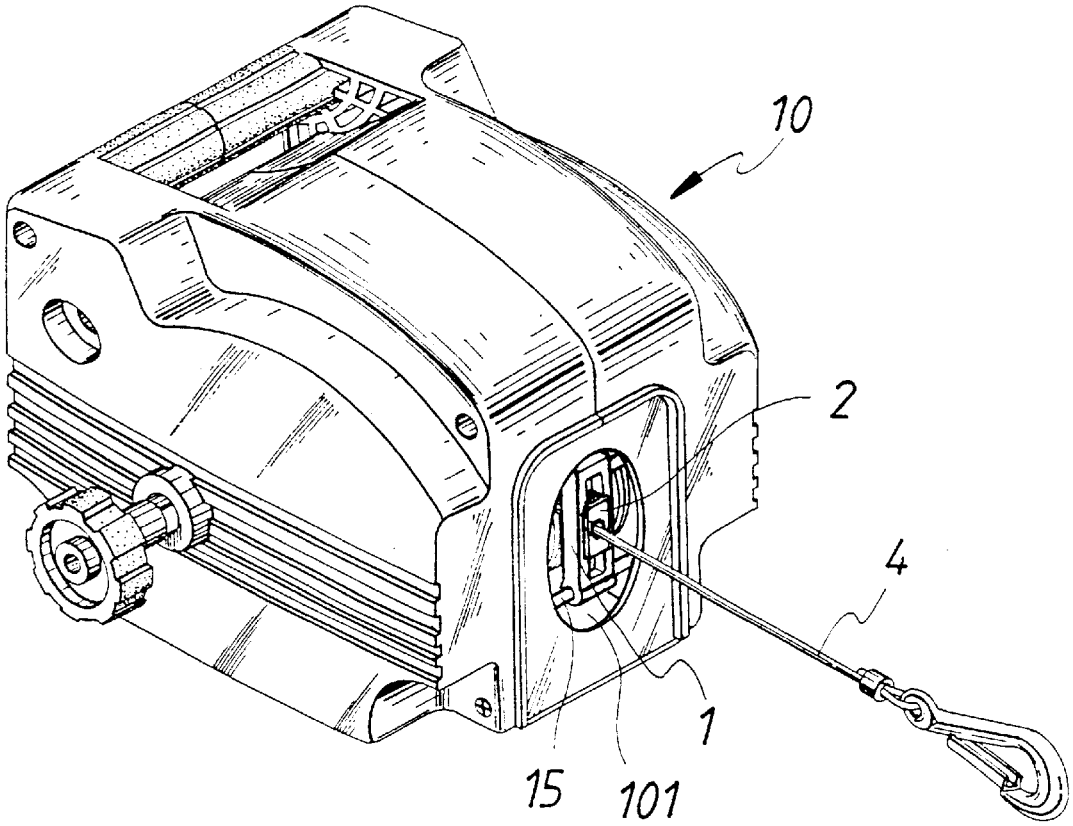
FIG. 2 is an assembled perspective view of the winch of the present invention.
Figure 3:
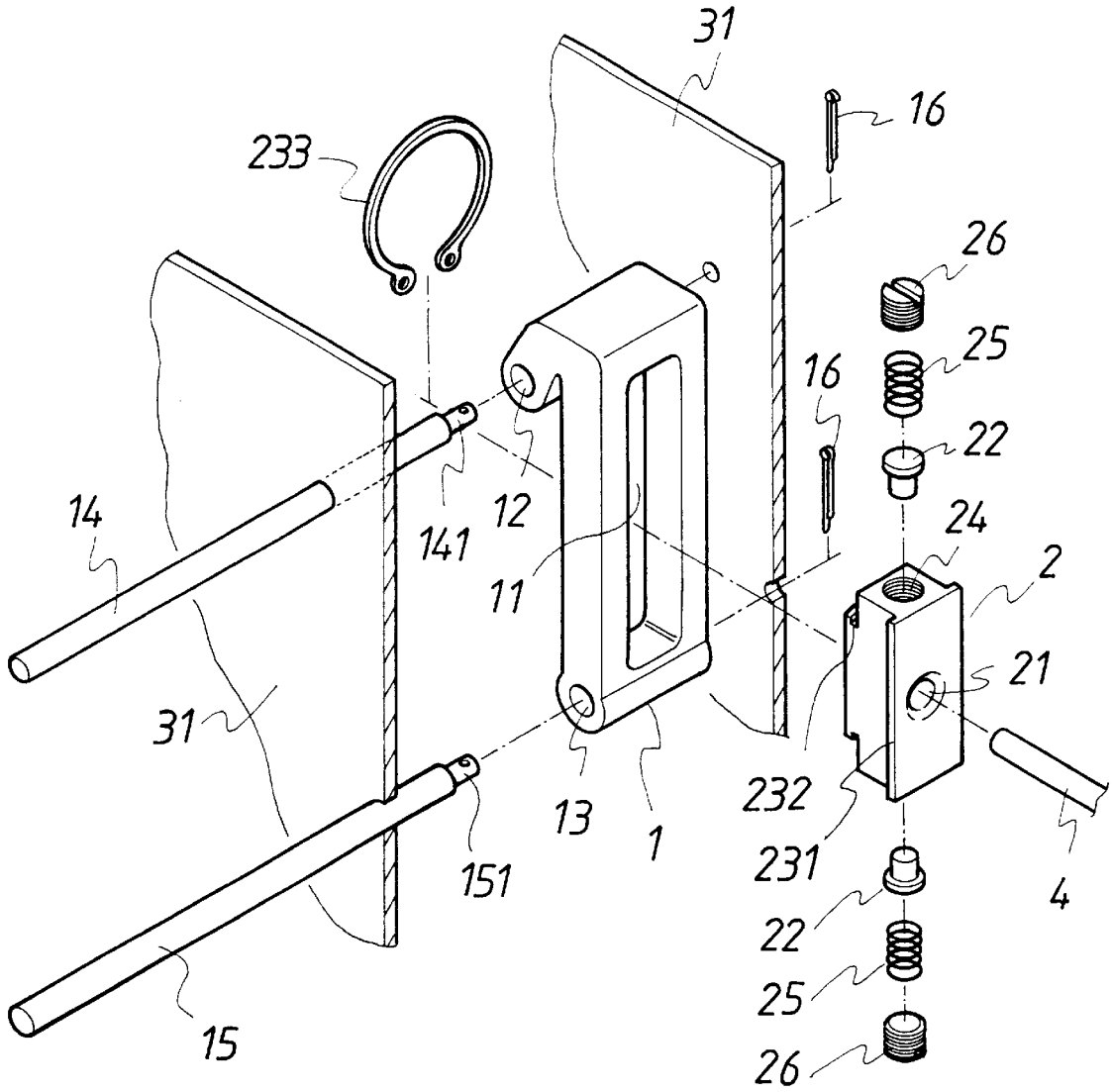
FIG. 3 is an exploded perspective view of the present invention.
Figure 4:
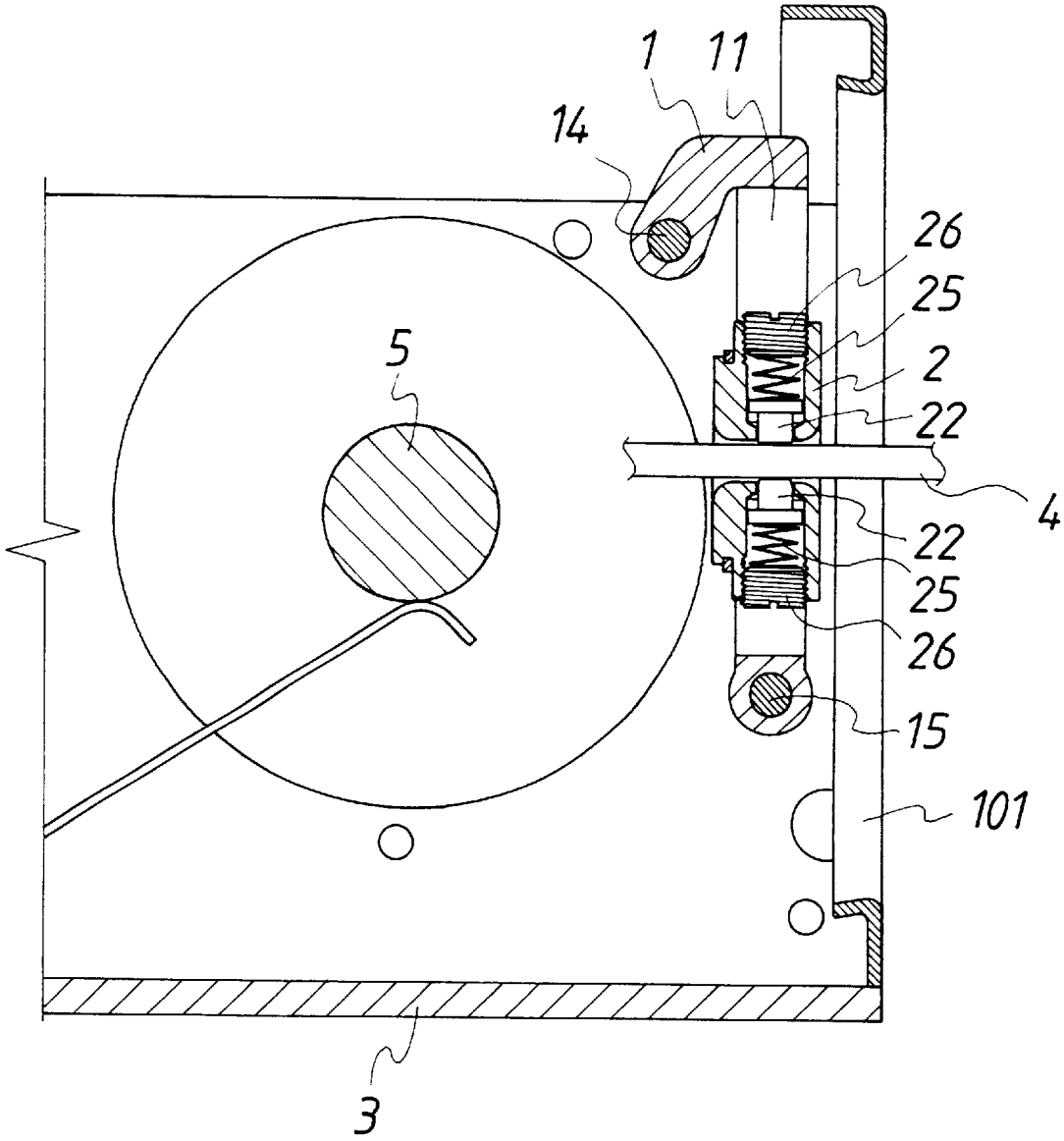
FIG. 4 is an assembled cross sectional view of the present invention.

Referring to FIGS. 2 and 3, the wire winding and ordering device for an electromotive winch of the present invention is illustrated. The present invention is mainly formed by a transversal displacement element 1 and a longitudinal displacement element 2 installed at a front opening 101 of the winch 10. The body of the transversal displacement element 1 has a longitudinal middle opening 11 with a predetermined length. The upper and lower ends thereof have through hole 12 and through hole 13. An upper sliding rod 14 and a lower sliding rod 15 on the two shrouds 31 on the seat 3 of the winch 10 penetrates through the through holes. The transversal displacement element I may slide freely in the front openings 101 of the winch 10. The longitudinal displacement element 2 is movably combined to the longitudinal middle opening 11 of the transversal displacement element 1 and can be longitudinally slide freely in the longitudinal middle opening 11. The body of the longitudinal displacement element 2 has a through hole 21. A twisting wire 4 passes through the through hole 21. At one side or two sides being penetrated by the twisting wire are embedded with elastic resisting element 22. Thereby, the twisting wire 4 may be ordered effectively by elastically clamping (referring to FIG. 4).

Figure 5:
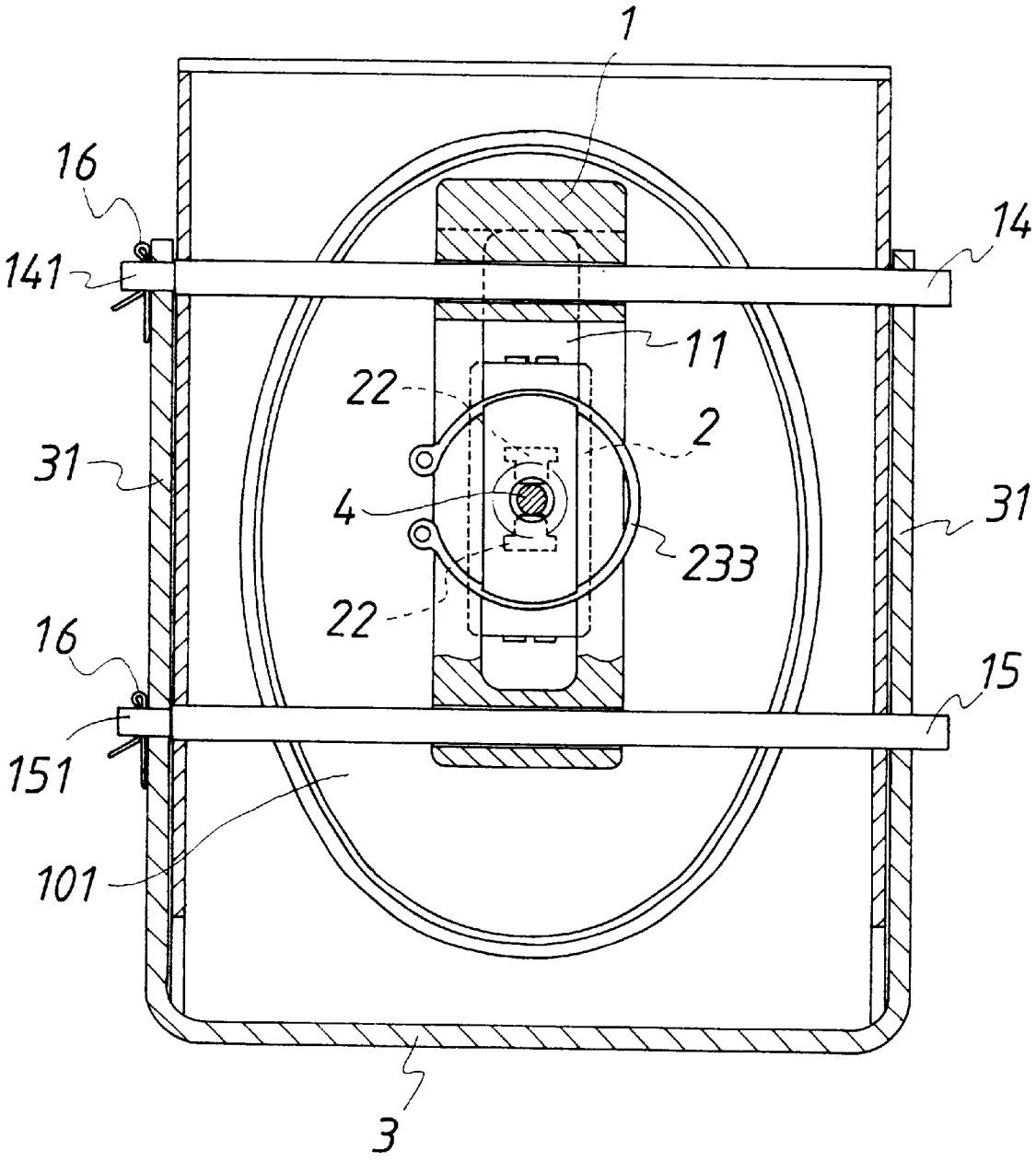
FIG. 5 is an assembled cross sectional view of the present invention which is viewed from another view angle.

By above components, a front opening 101 of the winch 10 is formed with a wire winding and ordering device for an electromotive winch (referring to FIG. 5). When the twisting wire 4 is wound or released, the twisting wire 4 may be ordered to enter into the scrolling shaft 5 of the winch 10. The transversal displacement element 1 moves transversally with the winding and releasing of the twisting wire 4. Thereby, the twisting wire 4 may be wound or releasing in order.

Above mentioned longitudinal displacement element 2 moves longitudinally based on the releasing or winding of the twisting wire 4. Namely, when more twisting wire 4 winds around the scrolling shaft 5, the longitudinal displacement element 2 is positioned at a higher position. On the contrary, when less twisting wire 4 around the scrolling shaft 5, the longitudinal displacement element 2 will fall to a lower place automatically.

As the embodiment illustrated in the drawings, when the transversal displacement element 1 is assembled to the longitudinal displacement element 2, the front end surface of the longitudinal displacement element 2 has a large stepped portion 231. The rear end thereof is formed with a trench 232. The longitudinal displacement element 2 can be embedded into the longitudinal middle opening 11 of the transversal displacement element 1. Then it is embedded into the trench 232 through a C ring 233. The two are combined movably. In practical, the ways for combination the transversal displacement element 1 and longitudinal displacement element 2 are not confined by the specific way described above. The above said embodiment are only one example, while other examples serving for the same object can be used in the present invention, and thus are within the scope of the present invention.

For the longitudinal displacement element 2, the elastic resisting element 22 at one or two sides of the twisting wire 4 is embedded into the screw hole 24 of the longitudinal displacement element 2 in advance. The screw hole 24 is communicated with the through hole 21 of the twisting wire 4. An upper end of the elastic resisting element 22 can be installed with a compressing spring 25 and is locked through a retaining stud 26. Thereby, the clamping force between the elastic resisting element 22 and the twisting wire 4 can be adjusted as desired by the retaining stud 26.

One end of each of the upper sliding rod 14 and lower sliding rod 15 on the two shrouds 31 of the seat 3 may be small step portion, 141, 151. Thereby, as they pass through the shroud plate 31 of the seat 3, the pin 16 can be inserted therein.

Figure 6:
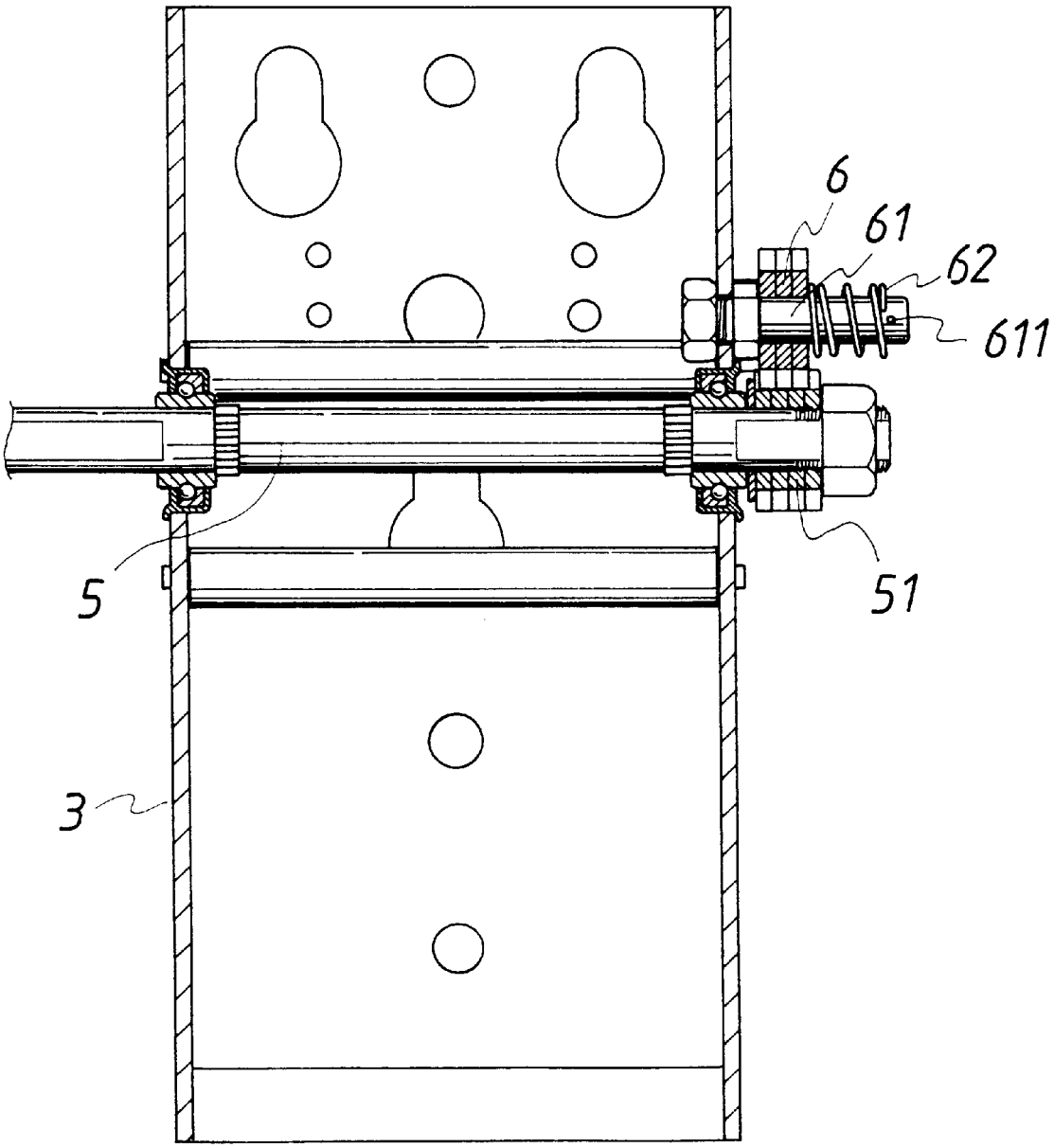
FIG. 6 is an assembled schematic view showing that the present invention is installed with a resisting gear.

Referring to FIG. 6, in the present invention, a predetermined end of the scrolling shaft 5 of the winch 10 can be installed with a resisting gear 6 which is engaged with a gear 51 firmly secured to a corresponding end of the scrolling shaft 5. The resisting gear 6 is installed to a gear shaft 61. A compressing spring 25 presses the gear shaft 61 for increasing the resisting force. Thereby, the inertial force generated from the rotation of the scrolling shaft 5 is reduced. Thereby, the twisting wire 4 in the scrolling shaft 5 can not loose and thereby, the twisting wire 4 will disorder. The distal end of the gear shaft 61 has a pin buckle 611 for preventing the compressing spring 62 from falling down.

The wire winding and ordering device for an electromotive winch is used for twisting wire 4 of no burden. The longitudinal displacement element 2 serves to provide the function of clamping and ordering. Although no gravitational force is applied to the twisting wire 4, the rigidity of the twisting wire 4 can be overcome. With the transversal displacement element 1, the twisting wire 4 can be wound orderly. The resisting gear 6 may reduce the inertial force from the rotation of the scrolling shaft 5. Thus, the twisting wire 4 on the scrolling shaft 5 will not disorder due to looseness.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A wire winding and ordering device for an electromotive winch, comprising:

a transversal displacement element and a longitudinal displacement element;

the transversal displacement element is installed at a front opening of the winch and is slidable transversely;

a body of the transversal displacement element has a longitudinal middle opening with a predetermined length;

the longitudinal displacement element is connected to the longitudinal middle opening of the transversal displacement element and longitudinally slide freely in the longitudinal middle opening;

a body of the longitudinal displacement element has a through hole;

a twisting wire passes through the through hole;

at least one side of the through hole penetrated by the twisting wire is embedded with an elastic resisting element when the twisting wire is wound or released, the twisting wire is wound on a scrolling shaft of the winch; and the transversal displacement element moves transversely with the winding and releasing of the twisting wire; and thereby, the twisting wire is wound or released.

2. The wire winding and ordering device for an electromotive winch as claimed in claim 1, wherein an upper and an lower ends of the transversal displacement element includes upper and lower through holes that receive an upper sliding rod and a lower sliding rod respectively, the rods connect to two spaced-apart shrouds of a seat of the winch, so that the transversal displacement element is movable longitudinally at the front opening at the seat of the winch.

3. The wire winding and ordering device for an electromotive winch as claimed in claim 1, wherein a front end surface of the longitudinal displacement element has a large stepped portion; a rear end thereof is formed with a trench; the longitudinal displacement element is embedded into the longitudinal middle opening of the transversal displacement element, and the transversal displacement element; is embedded into the trench through a C ring.

4. The wire winding and ordering device for an electromotive winch as claimed in claim 1, wherein an elastic resisting element is embedded in the screw hole in the longitudinal displacement element; the screw hole is communicated with the through hole of the twisting wire; and an upper end of the elastic resisting element is installed with a compressing spring and is locked with a retaining stud.

5. The wire winding and ordering device for an electromotive winch as claimed in claim 2, wherein one end of each of the upper sliding rod and the lower sliding rod on two shrouds of the seat has a small step portion, such that as the sliding rods pass through the shroud plate of the seat, a pin can be inserted therein.

6. The wire winding and ordering device for an electromotive winch as claimed in claim 1, wherein a predetermined end of the scrolling shaft of the winch is installed with a resisting gear which is engaged with a gear firmly secured to a corresponding end of the scrolling shaft.

7. The wire winding and ordering device for an electromotive winch as claimed in claim 6, wherein the resisting gear is installed to a gear shaft; a compressing spring presses the gear shaft for increasing the resisting force, so that the inertial force generated from the rotation of the scrolling shaft is reduced; the twisting wire in the scrolling shaft can not become loose and thereby, the twisting wire will disorder; the distal end of the gear shaft has a pin buckle for preventing the compressing spring from falling down.

* * * * *